US006843734B2

(12) United States Patent
Iwami

(10) Patent No.: US 6,843,734 B2
(45) Date of Patent: Jan. 18, 2005

(54) GOLF BALL

(75) Inventor: Satoshi Iwami, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/614,157

(22) Filed: Jul. 8, 2003

(65) Prior Publication Data

US 2004/0023732 A1 Feb. 5, 2004

(30) Foreign Application Priority Data

Aug. 5, 2002 (JP) ..... 2002-226802

(51) Int. Cl.[7] ..... A63B 37/12
(52) U.S. Cl. ..... 473/378
(58) Field of Search ..... 473/378, 377, 473/351

(56) References Cited

U.S. PATENT DOCUMENTS 4,123,061 A * 10/1978 Dusbiber ..... 473/377
4,431,193 A * 2/1984 Nesbitt ..... 473/374
6,561,925 B2 * 5/2003 Watanabe et al. ..... 473/371
6,699,957 B2 * 3/2004 Gajewski et al. ..... 528/65

FOREIGN PATENT DOCUMENTS

JP 10-305115 A 11/1998

* cited by examiner

*Primary Examiner*—Raeann Gorden
(74) *Attorney, Agent, or Firm*—Birch, Stewart, Kolasch & Birch, LLP

(57) ABSTRACT

Golf ball 1 has a core 2 and a cover 3. The cover 3 is formed from a polymer composition. A coefficient of loss at −20° C., T(−20), and a complex elastic modulus at −20° C., E(−20) Kgf/cm$^2$, of this polymer composition satisfy the following mathematical formula (I):

$$T(-20) \geqq 4.2*10^{-5}*E(-20)-0.24 \quad \text{(I).}$$

The coefficient of loss T(−20) is equal to or greater than 0.05 and equal to or less than 0.50, and particularly equal to or greater than 0.05 and equal to or less than 0.40. The complex elastic modulus E(−20) is equal to or greater than 500, and particularly equal to or greater than 1000. The thickness of the cover is equal to or greater than 0.3 mm and equal to or less than 1.4 mm, and particularly equal to or greater than 0.3 mm and equal to or less than 1.0 mm.

6 Claims, 2 Drawing Sheets

GOLF BALL

BACKGROUND OF THE INVENTION

1. Field of the Invention

The present invention relates to golf balls. More particularly, the present invention relates to improvement of covers of golf balls.

2. Description of the Related Art

Golf balls hit by a golf club make a flight with accompanying back spin. This back spin results from shearing force which occurs upon impact of the golf ball on a head having a loft angle. Lift force acts on the golf ball through the back spin, leading to optimization of the height of a trajectory. Spin speed largely influences on the height of a trajectory and flight distance.

A golf ball that fell on the green rolls on the green and stops in due course. The movement from the falling point to the stop point is referred to as run or roll. Larger run will result in tumbling of the golf ball out of the green, or in long distanced stop point from a cup, which may lead to difficulties in patting thereafter. In instances of shots aiming at the green (in many instances, shots by an iron golf club), golf balls which provide less run are preferred. The faster the rotation speed of back spin upon falling becomes, the golf ball becomes more apt to stop running on the green. This is caused by rotational direction of the back spin which is reverse to rotational direction of the rolling golf ball.

A golf ball after impact may often make a flight with accompanying side spin. Side spin in a right direction results in a fade ball, and side spin in a left direction results in a draw ball. Golfers occasionally hit the fade or draw intentionally. On behalf of golf balls which are apt to be accompanied by side spin, golfers can easily hit the fade or draw.

Spin performances are thus significantly important to golf balls. General golf balls have a core and a cover. Because the cover is positioned on an outermost side except for a paint layer, it greatly participates in mechanisms of spin occurrence. A variety of improvements of cover materials have been proposed in an attempt to enhance spin performances (for example, Japanese Patent Laid-open No. 305115/1998).

Because spin performances are important demand characteristics, golfers have asked for further enhancement of spin performances. In recent years, golf balls with a cover having small thickness have been developed. According to such a type of golf balls, contribution ratio of the cover to spin performances tends to be small. Therefore, there exist urgent needs for improvement of qualities of materials for such a thin cover.

SUMMARY OF THE INVENTION

A golf ball according to the present invention has a core and a cover. This cover is formed from a polymer composition. A coefficient of loss at −20° C., T(−20), and a complex elastic modulus at −20° C., E(−20), of this polymer composition satisfy the following mathematical formula (I). The coefficient of loss and the complex elastic modulus are measured by a viscoelasticity spectrometer under a condition of: the dynamic distortion being 5% ; the frequency being 10 Hz; the temperature-elevating rate being 4° C./min.; and the deformation mode being tension. This golf ball is excellent in a spin performance.

$$T(-20) \geqq 4.2*10^{-5}*E(-20)-0.24 \quad \text{(I)}$$

Preferably, the coefficient of loss T(−20) and the complex elastic modulus E(−20) satisfy the following mathematical formula (II)

$$T(-20) \geqq 4.2*10^{-5}*E(-20)-0.116 \quad \text{(II)}$$

Preferably, the coefficient of loss T(−20) is equal to or greater than 0.05 and equal to or less than 0.50, whilst the complex elastic modulus E(−20) is equal to or greater than 500. More preferably, the coefficient of loss T(−20) is equal to or greater than 0.05 and equal to or less than 0.40, whilst the complex elastic modulus E(−20) is equal to or greater than 1000.

The polymer composition which satisfies the above mathematical formulae is suitable for a cover having the thickness of equal to or greater than 0.3 mm and equal to or less than 1.4 mm, and is particularly suitable for a cover having the thickness of equal to or greater than 0.3 mm and equal to or less than 1.0 mm.

DESCRIPTION OF THE PREFERRED EMBODIMENTS

The present invention is hereinafter described in detail according to the preferred embodiments of the present invention, with appropriate references to the accompanying drawing.

Figure 1:
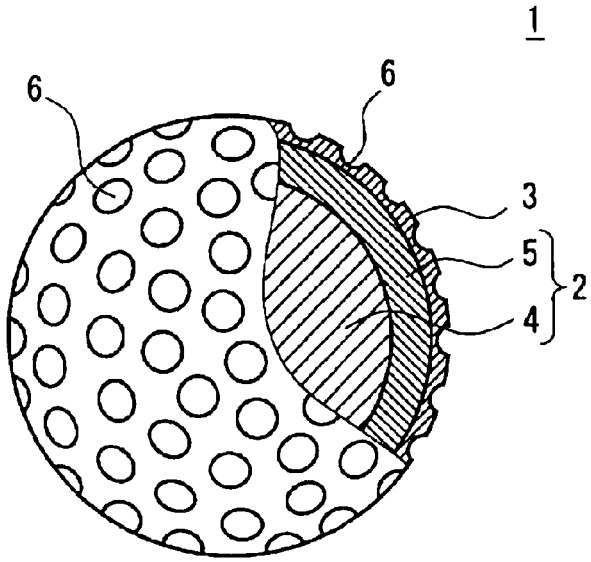
FIG. 1 is a schematic cross-sectional view illustrating a golf ball according to one embodiment of the present invention.

A golf ball 1 depicted in FIG. 1 has a spherical core 2 and a cover 3. The core 2 is composed of a spherical center 4 and a mid layer 5. Numerous dimples 6 are formed on the surface of the cover 3. This golf ball 1 has a paint layer and a mark layer to the external side of the cover 3, although not shown in the Figure. This golf ball 1 has a diameter of from 40 mm to 45 mm in general, and in particular, of from 42 mm to 44 mm. In light of the reduction of air resistance in the range to comply with a rule defined by United States Golf Association (USGA), the diameter is preferably 42.67 mm or greater and 42.80 mm or less. Weight of this golf ball 1 is generally 40 g or greater and 50 g or less, and particularly 44 g or greater and 47 g or less. In light of the elevation of inertia in the range to comply with a rule defined by USGA, the golf ball 1 particularly preferably has weight of 45.00 g or greater and 45.93 g or less.

The cover 3 herein means an outermost layer except for the paint layer and the mark layer. There exist golf balls referred to as having a two-layered cover including an outer cover and an inner cover, however in this instance, the outer cover corresponds to the cover 3 herein.

The cover 3 is formed from a polymer composition. A coefficient of loss at −20° C., T(−20) , and a complex elastic modulus at −20° C., E(−20) Kgf/cm$^2$, of this polymer composition satisfy the following mathematical formula (I). Linear equation designated by a reference numeral L1 in FIG. 2 is represented by the following mathematical formula.

$$T(-20)=4.2*10^{-5}*E(-20)-0.24$$

Figure 2:
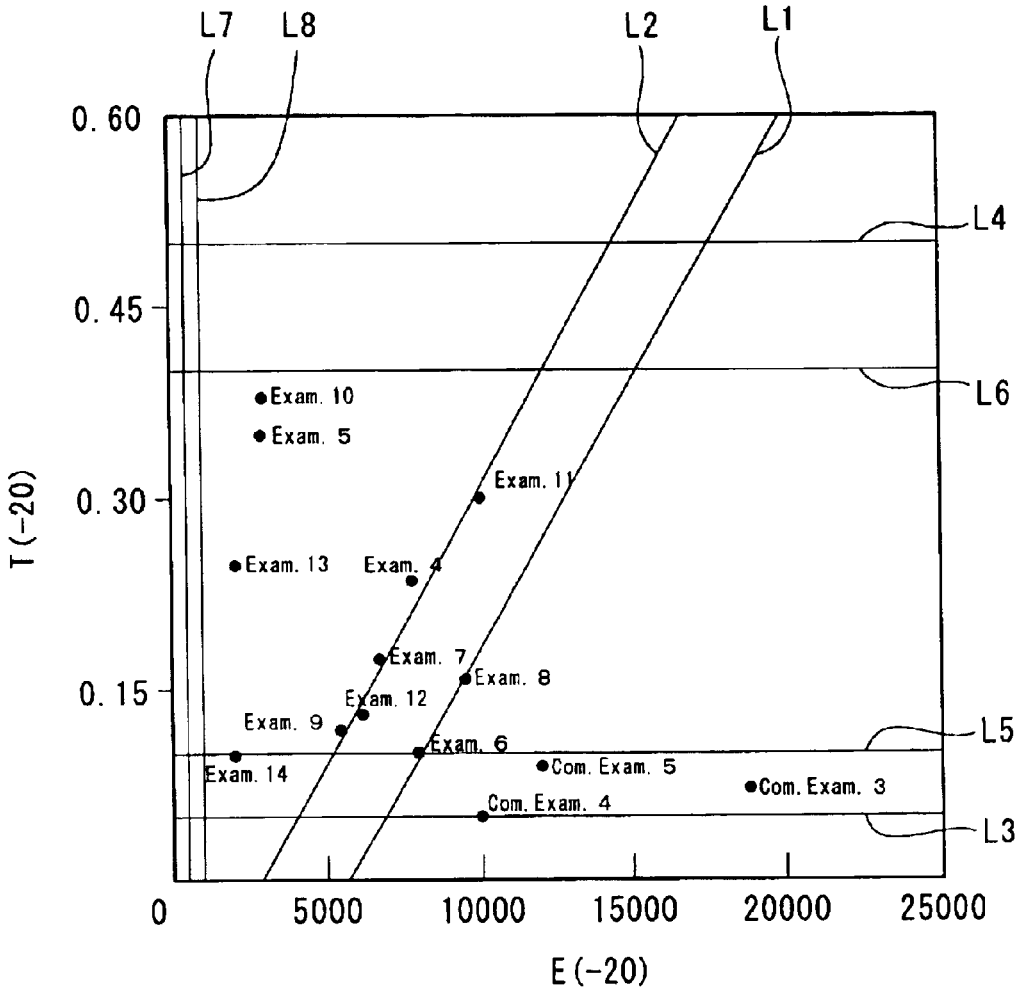
FIG. 2 is a graph demonstrating the relationship between the coefficient of loss T(−20) and the complex elastic modulus E(−20).

The polymer composition which satisfies the above mathematical formula (I) corresponds to the location just on the straight line L1, or in the upper region of the straight line L1 in FIG. 2. The golf ball 1 having the cover 3 which was formed from this polymer composition is excellent in a spin performance.

The coefficient of loss T(−20) is measured by a viscoelasticity spectrometer (Shimadzu Corporation, trade name "VA-200 improved model"). Conditions for the measurement are as presented below.

Initial distortion: 10%

Amplitude: 0.25%

Frequency: 10 Hz

Initiation temperature: −100° C.

Termination temperature: 100° C.

Temperature-elevating rate: 4° C./min

Deformation mode: tension

Test pieces subjected to the measurement by the viscoelasticity spectrometer are in a plate shape with the length of 45 mm, width of 4 mm and thickness of 2 mm. This test piece is zipped at both ends, and subjected to the measurement. The length of a displacement part of the test piece is 30 mm. This test piece is cut out from a slab having the thickness of 2 mm. This slab is formed from a polymer composition which is identical to that for the cover 3.

Preferably, the coefficient of loss at −20° C., T(−20), and the complex elastic modulus at −20° C., E(−20) Kgf/cm$^2$, of this polymer composition satisfy the following mathematical formula (II). Linear equation designated by a reference numeral L2 in FIG. 2 is represented by the following mathematical formula.

$$T(-20)=4.2*10^{-5}*E(-20)-0.116$$

The polymer composition which satisfies the above mathematical formula (II) corresponds to the location just on the straight line L2, or in the upper region of the straight line L2 in FIG. 2.

Linear equation designated by a reference numeral L3 in FIG. 2 is represented by the following mathematical formula.

$$T(-20)=0.05$$

Linear equation designated by a reference numeral L4 in FIG. 2 is represented by the following mathematical formula.

$$T(-20)=0.50$$

Linear equation designated by a reference numeral L5 in FIG. 2 is represented by the following mathematical formula.

$$T(-20)=0.10$$

Linear equation designated by a reference numeral L6 in FIG. 2 is represented by the following mathematical formula.

$$T(-20)=0.40$$

The coefficient of loss T(−20) of the polymer composition is preferably equal to or greater than 0.05 and equal to or less than 0.50. In other words, it is preferred that the polymer composition corresponds to the location within the region framed by the straight line L3 and the straight line L4. By setting the coefficient of loss T(−20) to be equal to or greater than 0.05, the spin performance is further enhanced. In this respect, the coefficient T(−20) of loss is particularly preferably equal to or greater than 0.10. In other words, it is particularly preferred that the polymer composition corresponds to the location just on the straight line L5, or in the upper region of the straight line L5. By setting the coefficient of loss T(−20) to be equal to or less than 0.50, a resilience performance of the golf ball 1 is enhanced. In this respect, the coefficient of loss T(−20) is particularly preferably equal to or less than 0.40. In other words, it is particularly preferred that the polymer composition corresponds to the location just on the straight line L6, or in the lower region of the straight line L6.

Linear equation designated by a reference numeral L7 in FIG. 2 is represented by the following mathematical formula.

$$E(-20)=500$$

Linear equation designated by a reference numeral L8 in FIG. 2 is represented by the following mathematical formula.

$$E(-20)=1000$$

The complex elastic modulus E(−20) of the polymer composition is preferably equal to or greater than 500. In other words, it is preferred that the polymer composition corresponds to the location just on the straight line L7, or in the right side region of the straight line L7. Accordingly, the resilience performance of the golf ball 1 is enhanced. In this respect, the complex elastic modulus E(−20) of the polymer composition is preferably equal to or greater than 1000. In other words, it is preferred that the polymer composition corresponds to the location just on the straight line L8, or in the right side region of the straight line L8.

The thickness of the cover 3 is preferably 0.3 mm or greater and 2.0 mm or less. When the thickness is less than the above range, durability of the cover 3 may become insufficient, and in addition, difficulties in forming the cover 3 may be involved. In this respect, the thickness is more preferably equal to or greater than 0.5 mm, and particularly preferably equal to or greater than 0.8 mm. When the thickness is beyond the range described above, the resilience performance of the golf ball 1 may become insufficient. A thin cover 3 less contributes to the enhancement of the spin performance of the golf ball 1. By using the aforementioned polymer composition, a cover 3 which greatly contributes to spin performances is obtained even though it is thin. This polymer composition is suitable for the cover 3 having the thickness of equal to or less than 1.4 mm, and particularly the cover 3 having the thickness of equal to or less than 1.0 mm. The thickness of the cover 3 is measured at a site with no dimple 6 present.

As a base polymer for the cover 3, a thermoplastic resin (including thermoplastic elastomers), a thermosetting resin or a rubber is used, in general. Specific examples of the thermoplastic resin include polyamide resins, polyurethane resins, polyester resins, polyolefin resins, polystyrene resins and ionomer resins. Specific examples of the thermosetting resin include epoxy resins, polyurethane, polyimide, polyurea, urea resins and phenol resins. Two or more polymers may be used in combination. Modified form of the polymer as described above may be used, or a copolymer of two or more monomers may be also used.

To the polymer composition of the cover 3, may be blended coloring agents such as titanium dioxide, fillers such as barium sulfate, dispersants, anti-aging agents, ultraviolet absorbents, light stabilizers, fluorescent agents, fluorescent brightening agents and the like at an appropriate amount as needed. The cover 3 may be blended with powder of highly dense metal such as tungsten, molybdenum and the like for the purpose of adjusting specific gravity.

Hardness (Shore D) of the cover 3 is preferably 35 or greater and 60 or less. When the hardness is less than the above range, the resilience performance of the golf ball 1 may become insufficient. In this respect, the hardness is more preferably equal to or greater than 38. When the hardness is beyond the range described above, a feel at impact of the golf ball 1 may be hard. In this respect, the hardness is more preferably equal to or less than 55. Hardness is measured in accordance with a standard of ASTM-D 2240. For the measurement, a slab having the thickness of 2 mm consisting of the polymer composition which is identical to the cover 3 is used. Prior to the measurement, the slab is maintained in an environment of 23° C. for 2 weeks. Three slabs are superposed to measure the hardness.

The cover 3 may be formed by any of known methods. In general, an injection molding method is employed. A compression molding method in which half shells are used may also be employed.

In general, the center 4 is obtained through crosslinking of a rubber composition. Examples of suitable base rubber for use in the rubber composition include polybutadienes, polyisoprenes, styrene-butadiene copolymers, ethylene-propylene-diene copolymers, natural rubbers and the like. Two or more kinds of these rubbers may be used in combination. In view of the resilience performance, polybutadienes are preferred. Even in the case where another rubber is used in combination with a polybutadiene, to employ a polybutadiene as a predominant component is preferred. More specifically, it is preferred that a proportion of polybutadiene occupied in total base rubber be equal to or greater than 50% by weight, and particularly equal to or greater than 80% by weight. Among polybutadienes, high cis-polybutadienes are preferred, which have a percentage of cis-1,4 bond of equal to or greater than 40%, and particularly equal to or greater than 80%.

Mode of crosslinking in the center 4 is not particularly limited. Crosslinking agents which can be used include co-crosslinking agents, organic peroxides, sulfur and the like. For the ground that the resilience performance of the golf ball 1 can be improved, it is preferred that a co-crosslinking agent is used. Preferable co-crosslinking agent in view of the resilience performance is a monovalent or bivalent metal salt of α,β-unsaturated carboxylic acid having 2 to 8 carbon atoms. Specific examples of the preferable co-crosslinking agent include zinc acrylate, magnesium acrylate, zinc methacrylate and magnesium methacrylate. In particular, zinc acrylate is preferred which can result in a high resilience performance.

As a co-crosslinking agent, α, β-unsaturated carboxylic acid having 2 to 8 carbon atoms, and a metal oxide may be blended. Both components react in the rubber composition to give a salt. Examples of preferable α, β-unsaturated carboxylic acid include acrylic acid and methacrylic acid, and in particular, acrylic acid is preferred. Examples of preferable metal oxide include zinc oxide and magnesium oxide, and in particular, zinc oxide is preferred.

The amount of the co-crosslinking agent to be blended is preferably 10 parts or greater and 50 parts or less per 100 parts (by weight) of the base rubber. When the amount to be blended is less than the above range, the resilience performance of the golf ball 1 may become insufficient. In this respect, the amount to be blended is more preferably equal to or greater than 12 parts, and particularly preferably equal to or greater than 15 parts. When the amount to be blended is beyond the above range, a feel at impact of the golf ball 1 may be hard. In this respect, the amount to be blended is particularly preferably equal to or less than 45 parts.

In the rubber composition for use in the center 4, an organic peroxide may be preferably blended. The organic peroxide serves as a crosslinking agent in conjunction with the above-mentioned metal salt of α, β-unsaturated carboxylic acid, and also serves as a curing agent. By blending the organic peroxide, the resilience performance of the golf ball 1 may be improved. Examples of suitable organic peroxide include dicumyl peroxide, 1,1-bis(t-butylperoxy)-3,3,5-trimethylcyclohexane, 2,5-dimethyl-2,5-di(t-butylperoxy) hexane and di-t-butyl peroxide. Particularly versatile organic peroxide is dicumyl peroxide.

The amount of the organic peroxide to be blended is preferably 0.1 part or greater and 3.0 parts or less per 100 parts of the base rubber. When the amount to be blended is less than the above range, the resilience performance of the golf ball 1 may become insufficient. In this respect, the amount to be blended is more preferably equal to or greater than 0.2 part, and particularly preferably equal to or greater than 0.5 part. When the amount to be blended is beyond the above range, the feel at impact of the golf ball 1 may become hard. In this respect, the amount to be blended is particularly preferably equal to or less than 2.5 parts.

The center 4 may be blended with a filler for the purpose of adjusting specific gravity and the like. Examples of suitable filler include inorganic salts such as zinc oxide, barium sulfate, calcium carbonate and the like; and powder of highly dense metal such as tungsten, molybdenum and the like. The amount of the filler to be blended is determined ad libitum so that the intended specific gravity of the center 4 can be accomplished. Preferable filler is zinc oxide because it serves not only as a mere agent for adjusting specific gravity but also as a crosslinking activator. Various kinds of additives such as sulfur, anti-aging agents, coloring agents, plasticizers, dispersants and the like may be blended at an appropriate amount to the center 4 as needed. The center 4 may be further blended with powder of a crosslinked rubber or synthetic resin powder. Common crosslinking temperature of the center 4 is from 140° C. or greater and 180° C. or less, with the crosslinking time period of 10 minutes or longer and 60 minutes or less.

The diameter of the center 4 is set to be 25 mm or greater and 41 mm or less, and particularly 27 mm or greater and 40 mm or less.

The mid layer 5 may be composed of a crosslinked rubber or may be composed of a resin composition. When it is composed of a crosslinked rubber, the base rubber thereof may be similar to those for the center 4 as described above. Furthermore, similar co-crosslinking agent and organic peroxide to those which may be blended in the center 4 as described above can be blended. The amount of the co-crosslinking agent to be blended is preferably 10 parts or greater and 60 parts or less per 100 parts of the base rubber. When the amount to be blended is less than the above range, the resilience performance of the golf ball 1 may become insufficient. In this respect, the amount to be blended is more preferably equal to or greater than 15 parts, and particularly preferably equal to or greater than 20 parts. When the amount to be blended is beyond the above range, the feel at impact of the golf ball 1 may become deteriorated. In this respect, the amount to be blended is more preferably equal to or less than 50 parts, and particularly preferably equal to or less than 35 parts.

The amount of the organic peroxide to be blended in the rubber composition of the mid layer 5 is preferably 0.1 part or greater and 8.0 parts or less per 100 parts of the base rubber. When the amount to be blended is less than the above range, the resilience performance of the golf ball 1 may become insufficient. In this respect, the amount to be blended is more preferably equal to or greater than 0.2 part, and particularly preferably equal to or greater than 0.5 part. When the amount to be blended is beyond the above range, the feel at impact of the golf ball 1 may become hard. In this respect, the amount to be blended is more preferably equal to or less than 7.0 parts, and particularly preferably equal to or less than 4.0 parts. Also in the rubber composition of the mid layer 5, may be blended with similar filler and various kinds of additives to those which may be blended in the center 4 as described above.

When the mid layer 5 is composed of a resin composition, an ionomer resin, polyester, polyurethane polyolefin or any of various kinds of thermoplastic elastomers may be used as a base. A mixture of these compounds may be also used.

Of the ionomer resins, copolymers of α-olefin and α, β-unsaturated carboxylic acid having 3 to 8 carbon atoms in which part of the carboxylic acid is neutralized with a metal ion are suitable. As the α-olefin herein, ethylene and propylene are preferred. Acrylic acid and methacrylic acid are preferred as the α, β-unsaturated carboxylic acid. Examples of metal ion for use in the neutralization include: alkaline metal ions such as sodium ion, potassium ion, lithium ion and the like; bivalent metal ions such as zinc ion, calcium ion, magnesium ion and the like; trivalent metal ions such as aluminum ion, neodymium ion and the like. The neutralization may also be carried out with two or more kinds of metal ions. In light of the resilience performance and durability of the golf ball 1, particularly suitable metal ions are sodium ion, zinc ion, lithium ion and magnesium ion.

Examples of preferable thermoplastic elastomer include thermoplastic styrene elastomers, thermoplastic polyurethane elastomers, thermoplastic polyamide elastomers and thermoplastic polyester elastomers. Two or more kinds of the thermoplastic elastomers may be used in combination.

Examples of the thermoplastic styrene elastomer (thermoplastic elastomer containing styrene blocks) include styrene-butadiene-styrene block copolymers (SBS), styrene-isoprene-styrene block copolymers (SIS), styrene-isoprene-butadiene-styrene block copolymers (SIBS) hydrogenated SBS, hydrogenated SIS and hydrogenated SIBS. Exemplary hydrogenated SBS includes styrene-ethylene-butylene-styrene block copolymers (SEBS). Exemplary hydrogenated SIS includes styrene-ethylene-propylene-styrene block copolymers (SEPS). Exemplary hydrogenated SIBS include styrene-ethylene-ethylene-propylene-styrene block copolymers (SEEPS).

Thickness of the mid layer 5 is usually 0.5 mm or greater and 5.0 mm or less, and particularly 1.0 mm or greater and 2.5 mm or less.

The amount of compressive deformation of the core 2 is preferably 2.50 mm or greater and 3.50 mm or less. When the amount of compressive deformation is less than the above range, the feel at impact of the golf ball 1 may become hard. In this respect, the amount of compressive deformation is more preferably equal to or greater than 2.60 mm. When the amount of compressive deformation is beyond the above range, the feel at impact of the golf ball 1 may become heavy. In this respect, the amount of compressive deformation is more preferably equal to or less than 3.20 mm.

Upon the measurement of the amount of compressive deformation, a subject spherical body (core 2) is first placed on a hard plate made of metal. Next, a cylinder made of metal gradually descends toward the spherical body. Thus the spherical body is intervened between the bottom face of the cylinder and the hard plate, and is gradually deformed. A migration distance of the cylinder is measured, starting from the state in which initial load of 98 N is applied to the spherical body up to the state in which final load of 1274 N is applied thereto. This value of migration distance is referred to as an amount of compressive deformation.

Although the core 2 of the golf ball 1 is composed of the center 4 and the mid layer 5, a core having a single layered structure is allowed, and alternatively, three or more layers may constitute the core.

The amount of compressive deformation of the golf ball 1 is preferably 2.5 mm or greater and 3.5 mm or less. When the amount of compressive deformation is less than the above range, the feel at impact of the golf ball 1 may become hard. In this respect, the amount of compressive deformation is more preferably equal to or greater than 2.6 mm. When the amount of compressive deformation is beyond the above range, the feel at impact of the golf ball 1 may become heavy. In this respect, the amount of compressive deformation is more preferably equal to or less than 3.2 mm, and particularly preferably equal to or less than 3.0 mm.

EXAMPLES

Through the combination of specifications of a core and specifications of a cover which are presented in Table 4 and Table 5 below, golf balls of Examples 1 to 14 and Comparative Examples 1 to 5 were manufactured. These golf balls have a paint layer consisting of a known paint. Details of the specifications of the core are presented in Table 1 below. Details of the specifications of the cover are presented in Table 2 and Table 3 below.

TABLE 1

| | | Specification of Core | | | |
|---|---|---|---|---|---|
| | | I | II | III | IV |
| Center | High cis-polybutadiene *1 | 100 | 100 | 100 | 100 |
| | Zinc acrylate | 33 | 33 | 33 | 31.5 |
| | Zinc oxide | 12.0 | 14.0 | 7.5 | 12.6 |
| | Diphenyl sulfide *2 | 0.5 | 0.5 | 0.5 | 0.5 |
| | Dicumyl peroxide *3 | 1.0 | 1.0 | 0.8 | 0.8 |
| | Vulcanization temperature(° C.) | 170 | 170 | 170 | 170 |
| | condition time (min) | 15 | 15 | 15 | 15 |
| | Diameter (mm) | 40.0 | 37.0 | 32.5 | 33.5 |
| Mid layer | High cis-polybutadiene *1 | No mid layer | — | 100 | 100 |
| | Zinc acrylate | | — | 37 | 41 |
| | Zinc oxide | | — | 11.0 | 8.9 |
| | Diphenyl sulfide *2 | | — | 0.5 | 0.5 |
| | Dicumyl peroxide *3 | | — | 0.7 | 0.7 |
| | Ionomer resin *4 | | 50 | — | — |
| | Ionomer resin *5 | | 50 | — | — |
| | Vulcanization temperature(° C.) | | — | 170 | 170 |
| | condition time (min) | | — | 15 | 15 |
| Core diameter (mm) | | 40.0 | 40.0 | 40.0 | 41.2 |
| Surface hardness - Central hardness (Shore D) | | 18 | 17 | 13 | 16 |
| Amount of compressive deformation (mm) | | 2.85 | 2.60 | 2.70 | 2.80 |

*1 "BR-18", trade name by JSR Corporation

*2 Sumitomo Seika Chemicals Co., Ltd.

*3 NOF Corporation

*4 Ethylene-methacrylic acid copolymer, neutralized with Na "Himilan 1605", trade name by Mitsui-Dupont Polychemical Co. Ltd.

*5 Ethylene-methacrylic acid copolymer, neutralized with Zn "Himilan 1706", trade name by Mitsui-Dupont Polychemical Co. Ltd.

TABLE 2

| | Specification of Cover | | | | | | | | |
|---|---|---|---|---|---|---|---|---|---|
| | 1 | 2 | 3 | 4 | 5 | 6 | 7 | 8 | 9 |
| Elastolan ET195A *6 | 100 | — | — | — | — | — | — | — | — |
| Elastolan C90A *7 | — | 100 | — | — | — | — | — | — | — |
| Elastolan XNY97A *8 | — | — | 100 | — | — | — | — | — | — |
| Pelprene P150M *9 | — | — | — | 70 | — | — | — | — | — |
| Pelprene P75M *10 | — | — | — | 30 | — | — | — | — | — |
| RB820 *11 | — | — | — | — | 100 | — | — | — | — |
| H12MDI-PC based polyurethane elastomer *12 | — | — | — | — | — | 100 | — | — | — |
| Himilan 1605 *13 | — | — | — | — | — | — | — | 50 | — |
| Himilan 1706 *14 | — | — | — | — | — | — | — | 50 | — |
| Thermosetting urethane *15 | — | — | — | — | — | — | 100 | — | — |
| H12MDI-PCL based polyurethane elastomer *16 | — | — | — | — | — | — | — | — | 100 |
| Titanium dioxide | 2 | 2 | 2 | 2 | 2 | 2 | 2 | 2 | — |
| Slab hardness (Shore D) | 50D | 42D | 48D | 45D | 30D | 44D | 48D | 62D | 49D |
| E(−20) (Kgf/cm$^2$) | 7700 | 2920 | 7980 | 6650 | 18800 | 3350 | 5490 | 10000 | 12000 |
| T(−20) | 0.237 | 0.351 | 0.102 | 0.176 | 0.073 | 0.238 | 0.118 | 0.05 | 0.09 |

*6 Manufactured by BASF Japan Ltd., MDI-adipate based urethane elastomer, Hardness: 98A
*7 Manufactured by BASF Japan Ltd., MDI-adipate based urethane elastomer, Hardness: 90A
*8 Manufactured by BASF Japan Ltd., H12MDI-PTMG urethane elastomer, Hardness: 97A
*9 Manufactured by Toyobo Co., Ltd., Polyester elastomer, Hardness: 50D
*10 Manufactured by Toyobo Co., Ltd., Polyester elastomer, Hardness: 39D
*11 Manufactured by JSR Corporation, Syndiotactic 1,2-polybutadiene, Hardness: 40D
*12 Manufactured by DuPont, Ternary ionomer neutralized with Mg, Hardness: 44D
*13 Manufactured by Mitsui-Dupont Polychemical Co. Ltd., Binary ionomer neutralized with Na, Hardness: 61D
*14 Manufactured by Mitsui-Dupont Polychemical Co. Ltd., Binary ionomer neutralized with Zn, Hardness: 60D
*15 ADIPRENE ® LW520/LW570 (Manufactured by UNIROYAL CHEMICAL, prepolymer)/CUREHARD-MED ® (Manufactured by IHARA CHEMICAL INDUSTRY CO., LTD., curing agent) = 70/30/18
*16 Manufactured by BASF Japan Ltd., Hydrogenerated MDI-polycaprolactone diol based urethane elastomer, Hardness: 49A

TABLE 3

| | Specification of Cover | | | | |
|---|---|---|---|---|---|
| | 10 | 11 | 12 | 13 | 14 |
| Elastolan S90A *17 | 100 | — | — | — | — |
| Elastolan ET590 *18 | — | 100 | — | — | — |
| Elastolan XNY97A *8 | — | — | 75 | — | — |
| Pelprene P75M *10 | | | 25 | 100 | |
| Thermosetting urethane *19 | — | — | — | — | 100 |
| Titanium dioxide | 2 | 2 | 2 | 2 | 2 |
| Slab hardness (Shore D) | 43D | 42D | 46D | 39D | 40D |
| E(−20) (Kgf/cm$^2$) | 3000 | 10000 | 6160 | 2090 | 2010 |
| T(−20) | 0.380 | 0.300 | 0.131 | 0.250 | 0.099 |

*17 Manufactured by BASF Japan Ltd., MDI-adipate based elastomer, Hardness: 90A
*18 Manufactured by BASF Japan Ltd., MDI-adipate based elastomer, Hardness: 90A
*19 MDI-PTMG based prepolymer (NCO content: 8%)/Ethacure =100/15

[Measurement of Amount of Compressive Deformation]

By the process described above, the amount of compressive deformation of the golf ball was measured. The results are shown in Table 4 and Table 5 below.

[Measurement of Resilience Coefficient]

To the golf ball, was impacted a hollow cylinder made of aluminum of which weight being 200 g at a velocity of 45 m/s. Then, velocity of the hollow cylinder prior to and after the impact, and the velocity of the golf ball after the impact were measured. Thus, a resilience coefficient of the golf ball was determined. Mean values of data which resulted from 5 times measurement are shown in Table 4 and Table 5 below as indices.

[Measurement of Spin Speed]

A sand wedge was equipped with a swing machine (manufactured by True Temper Co.), and golf balls were hit with this sand wedge. Then, sequential photographs of the golf ball immediately after the impact were taken to measure the spin speed. The results are shown in Table 4 and Table 5 below. Data from Example 4 to 14 and Comparative Examples 3 to 5 with the specification of the core being IV are plotted on FIG. 2.

TABLE 4

| | Results of Evaluation | | | | | | | | | |
|---|---|---|---|---|---|---|---|---|---|---|
| | Example 1 | Example 2 | Example 3 | Example 4 | Example 5 | Example 6 | Example 7 | Example 8 | Example 9 | Example 10 |
| Core specification | I | II | III | IV | IV | IV | IV | IV | IV | IV |
| Core diameter (mm) | 40.0 | 40.0 | 40.0 | 41.2 | 41.2 | 41.2 | 41.2 | 41.2 | 41.2 | 41.2 |
| Cover specification | 1 | 1 | 1 | 1 | 2 | 3 | 4 | 6 | 7 | 10 |
| Cover hardness (Shore D) | 50 | 50 | 50 | 50 | 42 | 48 | 45 | 44 | 48 | 43 |
| Cover thickness (mm) | 1.4 | 1.4 | 1.4 | 0.8 | 0.8 | 0.8 | 0.8 | 0.8 | 0.8 | 0.8 |
| Amount of compressive deformation (mm) | 2.69 | 2.47 | 2.58 | 2.68 | 2.73 | 2.69 | 2.70 | 2.68 | 2.67 | 2.72 |
| Resilience coefficient (index) | 100 | 102 | 101 | 102 | 100 | 102 | 101 | 103 | 102 | 100 |
| Spin speed (rpm) | 7000 | 6600 | 6900 | 6800 | 7200 | 6400 | 6800 | 6400 | 6800 | 7300 |

TABLE 5

| | Results of Evaluation | | | | | | | | |
|---|---|---|---|---|---|---|---|---|---|
| | Example 11 | Example 12 | Example 13 | Example 14 | Comparative Example 1 | Comparative Example 2 | Comparative Example 3 | Comparative Example 4 | Comparative Example 5 |
| Core specification | IV | IV | IV | IV | I | II | IV | IV | IV |
| Core diameter (mm) | 41.2 | 41.2 | 41.2 | 41.2 | 40.0 | 40.0 | 41.2 | 41.2 | 41.2 |
| Cover specification | 11 | 12 | 13 | 14 | 5 | 5 | 5 | 8 | 9 |
| Cover hardness (Shore D) | 42 | 46 | 39 | 40 | 30 | 30 | 30 | 62 | 49 |
| Cover thickness (mm) | 0.8 | 0.8 | 0.8 | 0.8 | 1.4 | 1.4 | 0.8 | 0.8 | 0.8 |
| Amount of compressive deformation (mm) | 2.73 | 2.69 | 2.76 | 2.75 | 2.82 | 2.58 | 2.78 | 2.61 | 2.68 |
| Resilience coefficient (index) | 100 | 101 | 101 | 101 | 97 | 99 | 98 | 104 | 101 |
| Spin speed (rpm) | 6600 | 6600 | 7000 | 6900 | 6000 | 5700 | 5800 | 5700 | 6000 |

As is clear from Table 4 and Table 5, and FIG. 2, golf balls having the coefficient of loss T(−20) and the complex elastic modulus E(−20) within a specified range are excellent in the spin performance. Accordingly, advantages of the present invention are clearly indicated by these results of evaluation.

The golf ball according to the present invention is accompanied by little run. Golfers who use the golf ball according to the present invention can easily hit fade or draw.

The description herein above is merely for illustrative examples, and therefore, various modifications can be made without departing from the principles of the present invention.

What is claimed is:

1. A golf ball comprising a core and a cover, said cover formed from a polymer composition, wherein a coefficient of loss of said polymer composition at −20° C., T(−20) , measured by a viscoelasticity spectrometer under a condition of: the dynamic distortion being 5%; the frequency being 10 Hz; the temperature-elevating rate being 4° C./min.; and the deformation mode being tension, and a complex elastic modulus of said polymer composition at −20° C., E(−20) Kgf/cm$^2$, measured under the same condition satisfy the following mathematical formula (I):

$$T(-20) \geqq 4.2*10^{-5}*E(-20)-0.24 \quad \text{(I).}$$

2. The golf ball according to claim 1 wherein said coefficient of loss T(−20) and complex elastic modulus E(−20) satisfy the following mathematical formula (II):

$$T(-20) \geqq 4.2*10^{-5}*E(-20)-0.116 \quad \text{(II).}$$

3. The golf ball according to claim 1 wherein said coefficient of loss T(−20) is equal to or greater than 0.05 and equal to or less than 0.50, and said complex elastic modulus E(−20) is equal to or greater than 500.

4. The golf ball according to claim 3 wherein said coefficient of loss T(−20) is equal to or greater than 0.05 and equal to or less than 0.40, and said complex elastic modulus E(−20) is equal to or greater than 1000.

5. The golf ball according to claim 1 wherein the thickness of said cover is equal to or greater than 0.3 mm and equal to or less than 1.4 mm.

6. The golf ball according to claim 5 wherein the thickness of said cover is equal to or greater than 0.3 mm and equal to or less than 1.0 mm.

* * * * *